US005180157A

United States Patent [19]

Helit et al.

[11] Patent Number: 5,180,157

[45] Date of Patent: Jan. 19, 1993

[54] SELF CONTAINED TRANSPORT APPARATUS WITH DRAWER MOUNT

[75] Inventors: Thomas M. Helit, Bethel; Kenneth W. Lowell, Farmington; Karen P. Synnett, Seymour, all of Conn.

[73] Assignee: Pitney Bowes Inc., Stamford, Conn.

[21] Appl. No.: 816,440

[22] Filed: Dec. 30, 1991

[51] Int. Cl.[5] ..... B65H 7/00

[52] U.S. Cl. ..... 271/256; 271/272; 271/200; 198/586

[58] Field of Search ..... 271/256, 198, 200, 272, 271/275, 277, 306; 198/586

[56] References Cited

U.S. PATENT DOCUMENTS 4,570,923 2/1986 Hooper et al. ..... 271/275

4,807,868 2/1989 Hirst et al. ..... 271/256

*Primary Examiner*—D. Glenn Dayoan

*Assistant Examiner*—Steven M. Reiss

*Attorney, Agent, or Firm*—Charles R. Malandra, Jr.; Melvin J. Scolnick

[57] ABSTRACT

An apparatus for conveying sheets of paper along a paper path comprises an outer frame having an inlet end for connection to an upstream conveying device and an outlet end for connection to a downstream conveying device. The outer frame has a hollow interior and an opening in each of the inlet and outlet ends for conveying sheets through. There is a drawer frame slidably mounted to the outer frame. The drawer frame is slidable through an open side of the outer frame between a closed position within the outer frame to an open position outside the outer frame. There is structure mounted in the drawer frame for conveying along a paper path sheets of paper received from the upstream conveying device to the downstream conveying device. The conveying structure includes structure for driving the conveying structure. The drawer frame also has an opening at at each end for conveying sheets through, wherein the conveying structure is operational when the drawer frame is in the closed position and the paper path within the drawer frame is accessible when the drawer frame is in the open position. The conveying structure also includes at least one staging area for stopping the advancement of sheets being conveyed along the paper path.

6 Claims, 7 Drawing Sheets

SELF CONTAINED TRANSPORT APPARATUS WITH DRAWER MOUNT

RELATED APPLICATIONS

The following applications refer to subject matter related to the subject matter of this application:

U.S. application Ser. No. 816,441, filed Dec. 30, 1991, and still pending;

U.S. application Ser. No. 816,442, filed Dec. 30, 1991, and also still pending.

FIELD OF THE INVENTION

The present invention relates to document inserting machines which assemble batches of documents for insertion into envelopes and more particularly, to multi-station document inserting machines.

BACKGROUND OF THE INVENTION

Multi-station document inserting machines generally include a plurality of various stations which are configured for specific applications. Typically, such inserting machines, also known as console inserting machines, are manufactured to perform operations customized for a particular customer. Such machines are known in the art and are generally used by organizations which make up large volume mailings where the content of each mail piece may vary.

An example of a document inserting machine is disclosed in U.S. Pat. No. 4,547,856 issued to Piotroski, et al. on Oct. 15, 1985 and assigned to the assignee of the present invention. This inserting machine includes a plurality of serially arranged stations including an envelope feeder and insert station, a plurality of insert feeder stations and a burster-folder station. There is a computer generated forms or web feeder that feeds continuous form control documents having control coded marks printed thereon to the burster-folder station for separating and folding. The control marks on the control documents are sensed by a control scanner located in the burster-folder station. Thereafter, the serially arranged insert feeder stations sequentially feed the necessary documents onto a transport deck at each station as the control document arrives at the respective station to form a precisely collated stack of documents which is transported to the envelope feeder-insert station where the stack is inserted into the envelope. The transport deck preferably includes ramp feed so that the control document always remains on top of the stack of advancing documents.

Heretofore, inserting machines have included only one in-line feeder configured for handling control documents. Previously, control documents have preferably been web forms since compilation of the control information for each batch was most readily done through data processing with output through a line printer onto a web of computer printout forms. Accordingly, inserting machines have generally comprised one upstream in-line web feeder, or a plurality of parallel feeders, which feed accumulations of forms (i.e., a control form and optionally, one or more succeeding non-control forms from the web) into a inserting machine.

Some document inserting machines are configured with multiple document feeders each having scanning capability for scanning control information printed on the documents fed through the respective feeders. An example of such an inserting machine is disclosed in Piotroski U.S. Pat. No. 4,568,072, issued Feb. 4, 1976 and assigned to the assignee of the present invention. The inserting machine is configured with a plurality of web feeders that separate respective web forms into discrete documents which are eventually combined into predetermined batches. The web feeders are situated parallel to each other for feeding the discrete documents to a transport unit that conveys the forms in a direction orthogonal to the web feeders. Cut sheet feeders could be used in such a configuration in place of or in combination with the web feeders. However, such an arrangement of multiple feeders scanning control information has heretofore required that the feeders be configured parallel to each other.

Recently, inserting machines have included cut sheets containing control information printed thereon in the form of bar codes, dash codes and the like. In such machines, a high capacity cut sheet feeder is configured as the first upstream station for feeding the control document and non-control documents instead of a web feeder. Such feeders include a supply tray on which reams of cut sheets are loaded. The cut sheet feeders perform separation and singulation of the cut sheets whereby individual sheets are fed seriatim from the feeder along a paper path that begins at the outlet of the feeder. Such high capacity cut sheet feeders are used on the 8300 Series Inserters manufactured by Pitney Bowes of Stamford, Conn.

Other examples of such document inserting machines are described in U.S. Pat. No. 3,606,708, issued Sep. 21, 1971 to Sather, et al. and assigned to Bell & Howell Co., and U.S. Pat. No. 3,955,429, issued Jan. 27, 1976 to Braneky, et al. and assigned to the assignee of the present invention.

The aforementioned conventional inserting machines are not readily suitable for handling such new applications. This is especially true considering that such new applications are expected to operate at a higher throughput.

The aforementioned conventional inserting machines typically include one feeder for scanning the control feeder and communicating the scanned information to the control system of the machine whereby the remaining insert feeders are controlled. As previously stated, this feeder is typically the first upstream station which is usually a web feeder station, but may be a cut sheet feeder. The insert feeders are not suitable for handling a second set of cut sheets to be fed and scanned.

Heretofore, inserters have not included a configuration of two cut sheet feeders mounted in series to form discrete batches comprised of documents from each of the cut sheet feeders. Likewise, inserters have not included transports configured undercut sheet feeders. Such a configuration presents a problem concerning accessibility to the transport situated under a cut sheet feeder. Access is needed so that paper jams can be cleared and maintenance to the transport can be performed.

SUMMARY OF THE INVENTION

It has been found that for a configuration of a cut sheet feeder mounted over a transport assembly, a clam shell housing arrangement is not practical because of the size and sheet capacity of the feeder.

It has been found that access to a lower transport under a cut sheet feeder can be achieved by a self contained transport assembly mounted into a drawer frame.

Such a configuration provides accessibility without disturbing the cut sheet feeder above.

An apparatus for conveying sheets of paper along a paper path comprises an outer frame having an inlet end for connection to an upstream conveying device and an outlet end for connection to a downstream conveying device. The outer frame has a hollow interior and an opening in each of the inlet and outlet ends for conveying sheets through. There is a drawer frame slidably mounted to the outer frame. The drawer frame is slidable through an open side of the outer frame between a closed position within the outer frame to an open position outside the outer frame. There are means mounted in the drawer frame for conveying along a paper path sheets of paper received from the upstream conveying device to the downstream conveying device. The conveying means includes means for driving the conveying means. The drawer frame also has an opening at at each end for conveying sheets through, wherein the conveying means is operational when the drawer frame is in the closed position and the paper path within the drawer frame is accessible when the drawer frame is in the open position.

The conveying means includes a belt and pulley transport assembly suitably mounted to the drawer frame, and the drive means includes a motor mounted to the drawer frame and operatively coupled to the belt and pulley assembly. The conveying means also includes at least one staging area for stopping the advancement of sheets being conveyed along the paper path.

BRIEF DESCRIPTION OF THE DRAWINGS

A complete understanding of the present invention maybe obtained from the following detailed description of the preferred embodiment thereof, when taken in conjunction with the accompanying drawings wherein like reference numerals designate similar elements in the various figures, and in which.

DETAILED DESCRIPTION OF THE PREFERRED EMBODIMENT

Figure 1:
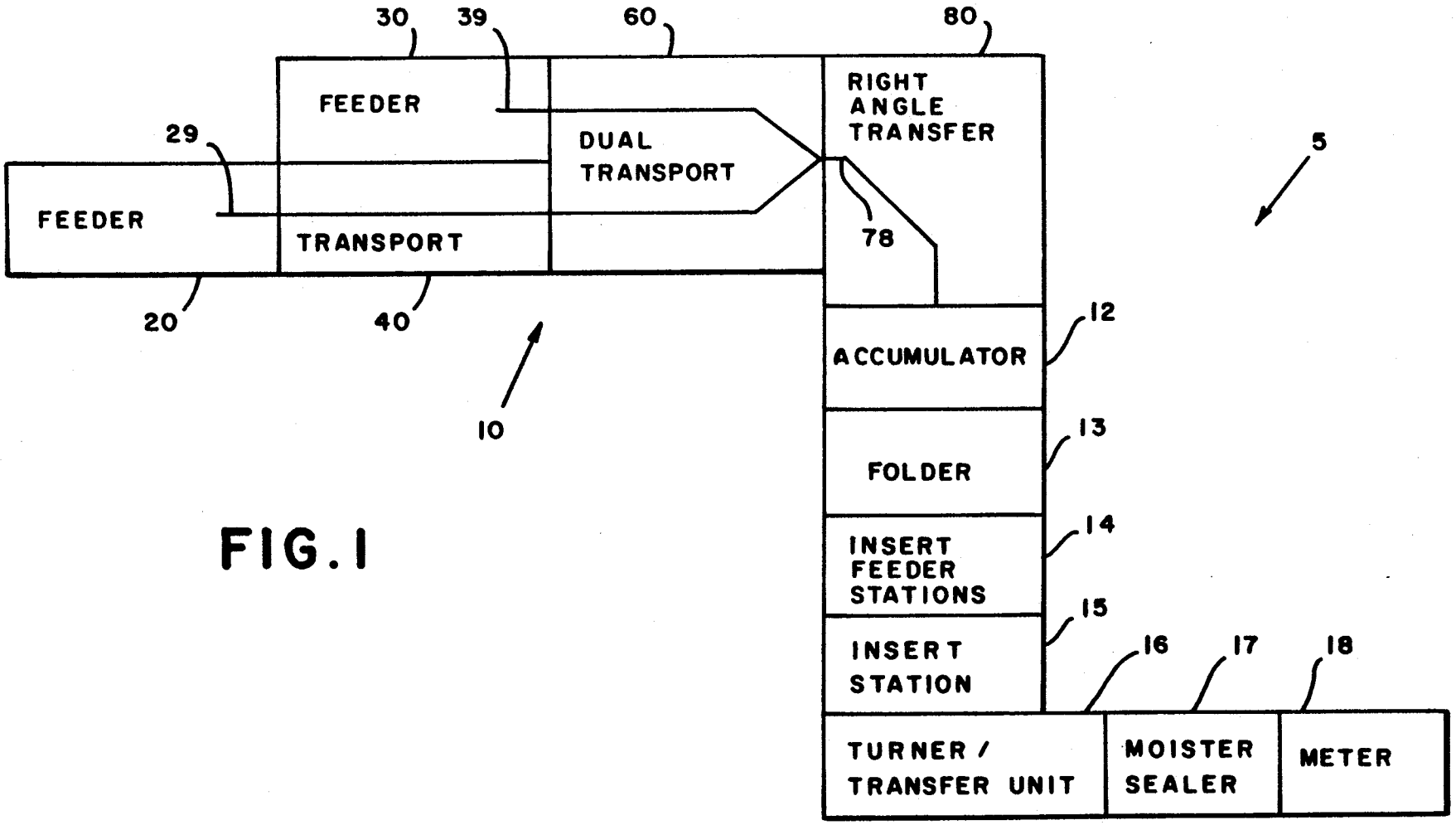
FIG. 1 is a schematic of a mailing machine in which the present invention is incorporated.

In describing the preferred embodiment of the present invention, reference is made to the drawings, wherein there is seen, in FIG. 1 a schematic of a document inserting machine, generally designated 5, for independently feeding sheets from two separate cut sheets feeders 20 and 30 arranged in-line and offset from one another at a cut sheet feeder section generally designated 10 comprising feeders 20 and 30, a lower transport 40, a dual transport and merge unit 60 and a right angle transport 80. The sheets fed by feeders 20 and 30 are conveyed along two separate paths 29 and 39 and then merged into one path 78 in dual transport 60. Right angle transport 80 changes the direction the cut sheets are conveyed to a direction orthogonal to the paper paths of cut sheet feeders 20 and 30 without turning the sheets. Once the direction of conveyance of the sheet is changed, the sheet is conveyed downstream for further processing at typical inserting machine stations, such as, accumulator 12, folder 13, insert feeder stations 14, and insert station 15.

Figure 2:
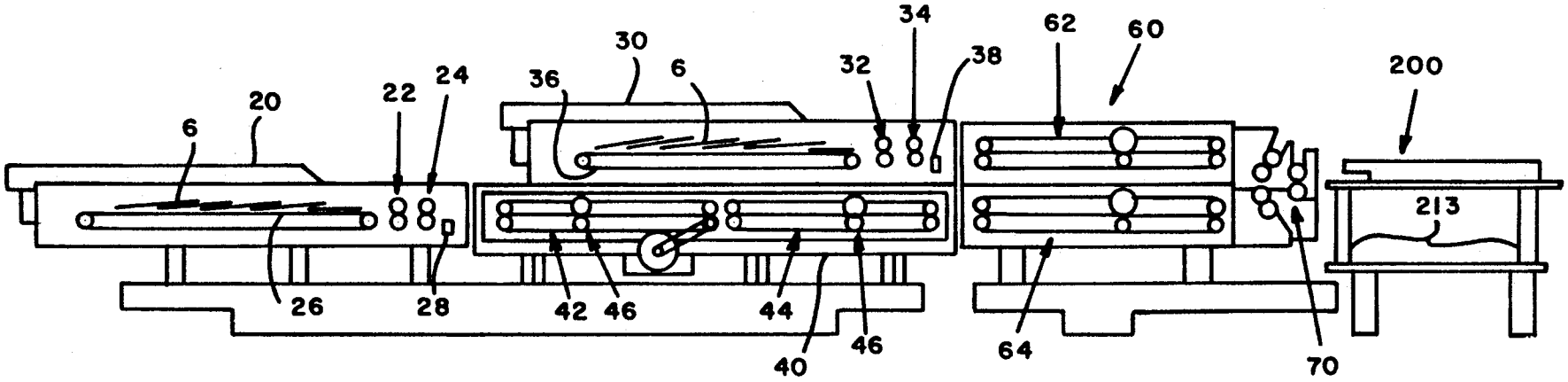
FIG. 2 is a side elevational view of a cut sheet feeder section of the mailing machine of FIG. 1.

Referring now to FIG. 2, cut sheet feeder section 10 is shown having a first high capacity cut sheet feeder 20 that separates and feeds seriatim cut sheets 6 along a first paper path 29 which begins at the outlet of separator rollers 24. Feeder 20 includes a stacking deck on which reams of cut sheets 6 are stacked. There is a conveying means 26 and prefeed rollers 22 which urge the bottom sheet towards separating rollers 24 in a shingled manner for a bottom sheet feed into paper path 29. There is also a scanner 28 for reading the control code printed on the cut sheets as they are fed. An example of feeder 20 is the high capacity sheet feeder that feeds cut sheets including control documents on the 8300 series inserters manufactured by Pitney Bowes Inc. of Stamford, Conn.

There is a second high capacity cut sheet feeder 30 that is identically configured as feeder 20 but located downstream and elevated above feeder 20. Feeder 30 separates and feeds seriatim cut sheets along a second paper path 39 which begins at the outlet of separator rollers 34. Feeder 30 is identical in structure, operation and function as feeder 20. Feeder 30 includes conveying means 36, prefeed rollers 32 and scanner 38.

As previously stated, it is known to configure an inserting machine with one cut sheet feeder, such as feeders 20 or 30, at the most upstream position in an inserting machine. It is also known to feed from multiple cut sheet feeders in parallel onto a transport unit conveying in the direction perpendicular to the direction of the feed path out of the feeders. The present invention provides system and method of in-line feeding from two cut sheet feeders.

There is a dual stage transport 40 located directly below feeder 30 for receiving sheets fed from feeder 20 and conveying such sheets to a lower level transport of a dual transport and merge unit 60. Transport 40 includes a first section of upper and lower O-ring belts, generally designated 42, and a second section of upper and lower O-ring belts, generally designated 44, which serially act upon sheets 6 being conveyed. Sections 42 and 44 comprise conventional upper and lower O-ring conveying structure that will be described more completely below. Sections 42 and 44 each include a conventional trap assembly generally designated 46 for "staging", i.e. pausing, the conveying of sheets 6 fed from feeder 20 as necessary. Trap assembly 46 includes a pair of stop rollers controlled by a conventional clutch and brake arrangement. Paper path 29 continues through transport 40 between the lower reach of the upper belts and the upper reach of the lower belts.

Downstream from feeder 30 and transport 40 is a dual transport and merge unit 60 that includes upper and lower transport sections, generally designated 62 and 64, for conveying sheets from feeder 30 and transport 40 respectively. As best seen in FIGS. 1 and 2, the two separate paper paths 39 and 29 of transport sections 62 and 64 are merged into one paper path 78 at the downstream end of the unit 60. Transport and merge sections 62 and 64 each includes a conventional belt and pulley assembly that feeds into a set of merge rollers, generally designated 70. A more detailed description of transport and merge unit 60 is provided below.

Downstream from dual transport and merge unit 60 is a right angle transport assembly 80 for conveying sheets 6 at a right angle from the direction sheets 6 are conveyed from feeders 20 and 30. Right angle transport assembly includes a 45° transfer unit 200 that conveys sheets 6 into an alignment unit 250 which conveys in the direction orthogonal to paper paths 29 and 39. A more detailed description of right angle transport assembly is provided below.

Figure 3:
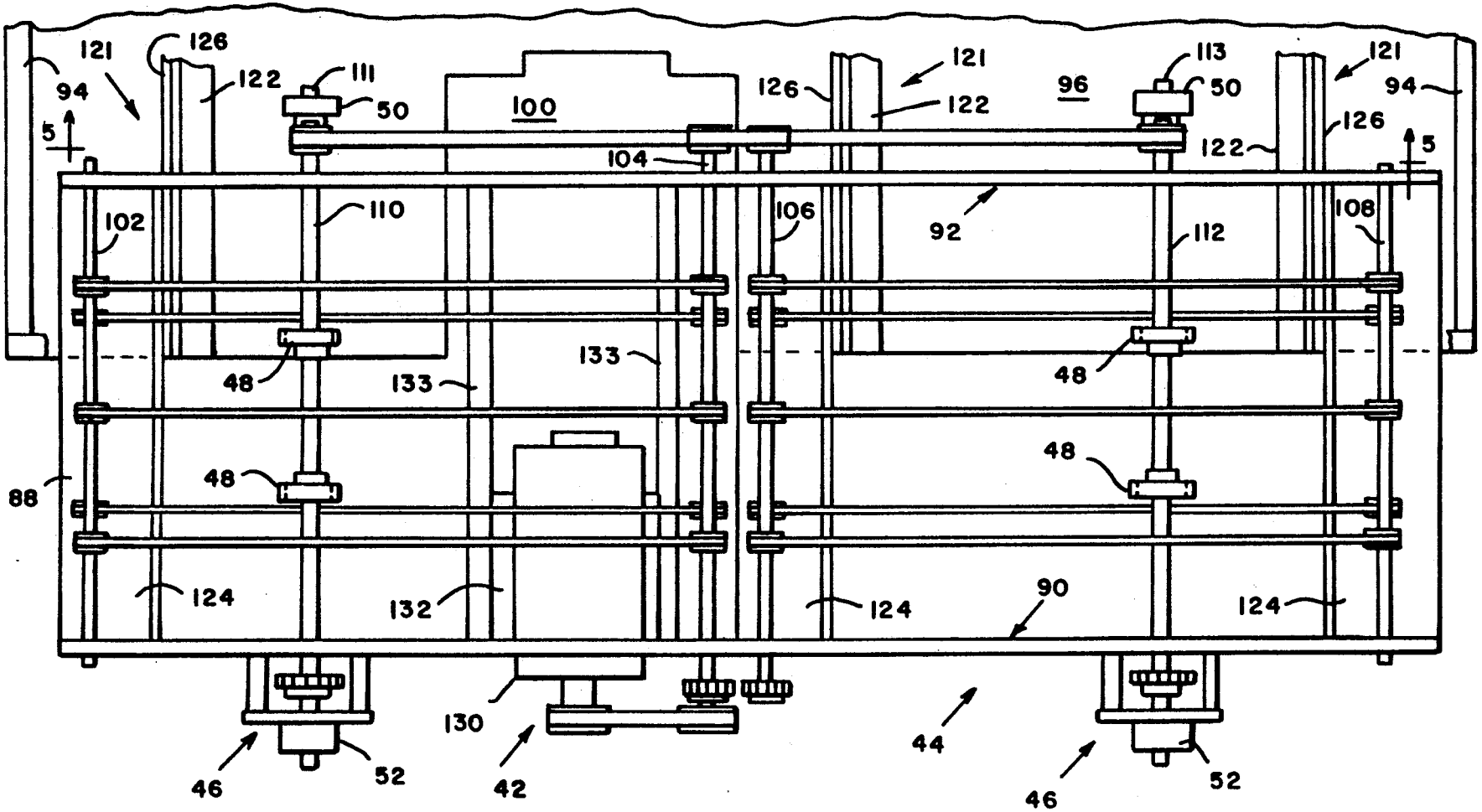
FIG. 3 is a plan view of a lower transport assembly mounted to drawer slides in the feeder section of FIG. 2.
Figure 5:
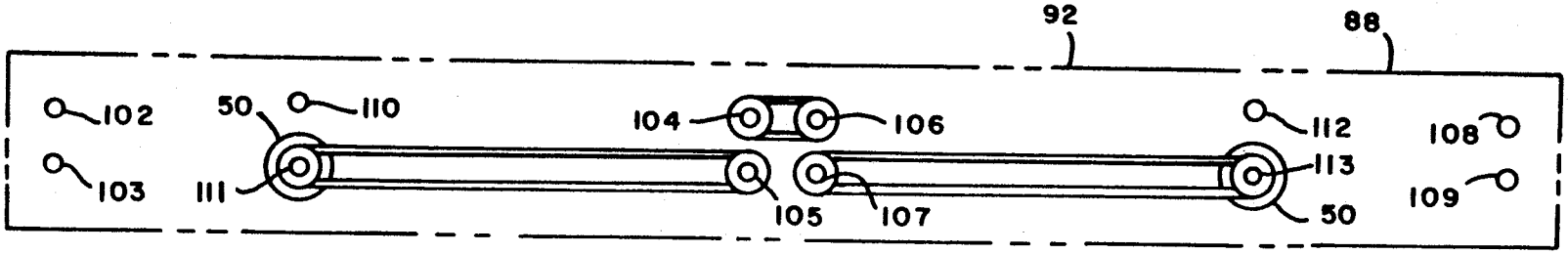
FIG. 5 is a side elevational view of the self contained drive configuration of the transport assembly of FIG. 3 taken along line 5—5.
Figure 4:
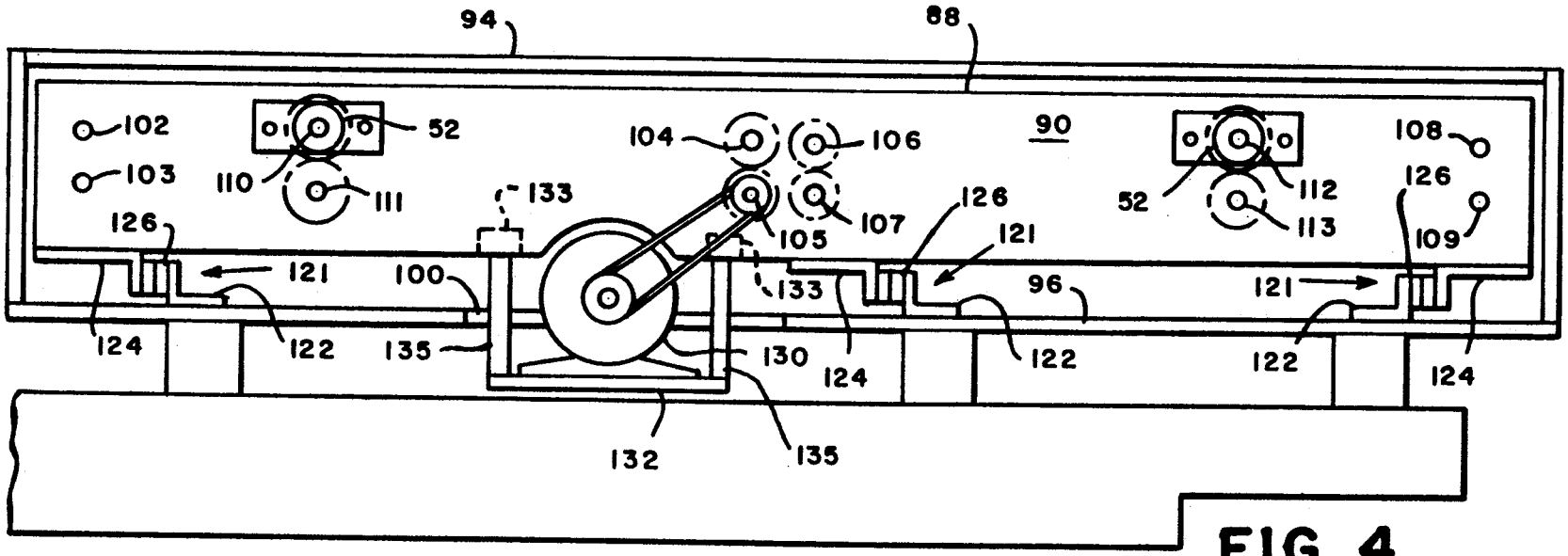
FIG. 4 is a side elevational view of the self contained drive configuration of the transport assembly of FIG. 3.

Referring now to FIGS. 3, 4 and 5, dual stage transport 40 comprises a first frame 88, having a rectangular shape and including side members 90 and 92, to which conventional o-ring belt and pulley transports 42 and 44 are suitably mounted. The upstream and downstream sections of frame 88 include an opening suitable for sheets 6 to be conveyed through. There is a second frame 94, including lower plate 96, that functions as a cabinet in which frame 88 is slidably mounted as a drawer. Second frame 94 is bounded by cut sheet feeder 20 and transport section 64 of dual transport and merge unit 60 at the upstream and downstream ends respectively. Cut sheet feeder 30 is mounted directly above frame 94. Frame 94 includes openings at the upstream and downstream ends for conveying sheets 6, and an opening surrounding side member 90 through which frame 88 can be pulled for drawer access to transports 42 and 44. Lower plate member 96 has a cut out section 100 for accepting a drive motor 130 for dual stage transport 40. Motor 130 is secured to a plate member 132 that is mounted to a pair of rails 133 by means of four stanchions 135. Shafts 102 through 113 are suitably journaled to side members 90 and 92 of frame 88. First frame 88 is mounted to second frame 94 by a three member slide assembly, generally designated 121, comprising a cabinet member 122 secured to lower plate member 96, a drawer member 124 secured to first frame 88 and an intermediate member 126. An example of such a slide assembly is a three member, full extension, positive stop slide assembly module number 301 manufactured by Accuride, a division of Standard Precision, Inc. of Sante Fe Springs, Calif.

Referring now to FIG. 4, motor 130 is part of a conventional friction drive system that drives shafts 104, 105, 106 and 107 of transport sections 42 and 44 respectively. Shafts 102, 103, 108 and 109 are idler shafts. Shafts 110, 111, 112 and 113, which are also driven by the drive system seen in FIG. 5, each contain two stop roller pairs 48. Stop rollers 48 are controlled by a conventional clutch 50 and brake 52 arrangement whereby sheets being conveyed through transport 40 can be selectively stopped at each staging area 46.

The aforementioned mounting arrangement of dual stage transport 40 provides a drawer access to the paper path in transport 40 so that jams can be cleared and maintenance be completed without the need to raise or remove cut sheet feeder 30. This is particularly significant considering the size and location of feeder 30 as well as the weight of the cut sheets loaded on the feed tray during operation of the machine. Heretofore, there has not been a need to access such a paper path as in transport 40 because cut sheet feeders have been the most upstream station in the inserting machine. The preferred embodiment of the present invention provides two cut sheet feeders arranged in-line and offset to one another which requires a transport under the downstream feeder. The clam shell arrangement used in dual transport and merge unit 60 is not suitable for transport 40 be cause of the size and weight of feeder 30 and the reams of sheets that would be stacked for feeding during the operation of the inserting machine. If such a clam shell arrangement were implemented, the stack of cut sheets loaded onto the load deck of feeder 30 would have to be removed before raising feeder 30 at a pivot point.

Transport 40, including motor 130 and drive assembly, is totally contained in first frame 88 to provide a drawer structure that can be pulled out from under feeder 30 for clearing jams and performing maintenance. In FIG. 3 drawer frame 88 is shown partially out of frame 94. In the preferred embodiment of the present invention, the power cord (not shown) to the motor 130 is clamped to a folding bracket (not shown) that extends when the drawer is pulled out. The bracket folds to a closed position when the drawer is in its operating position. Such a bracket is cable carrier model number CC5-1 manufactured by Accuride, a division of Standard Precision Inc. of Sante Fe Springs, Calif. A means for locking frame 88 in a closed position, for example, a magnetic latching mechanism, can be used to prevent frame 88 from separating from frame 94 under normal operating conditions.

Figure 7:
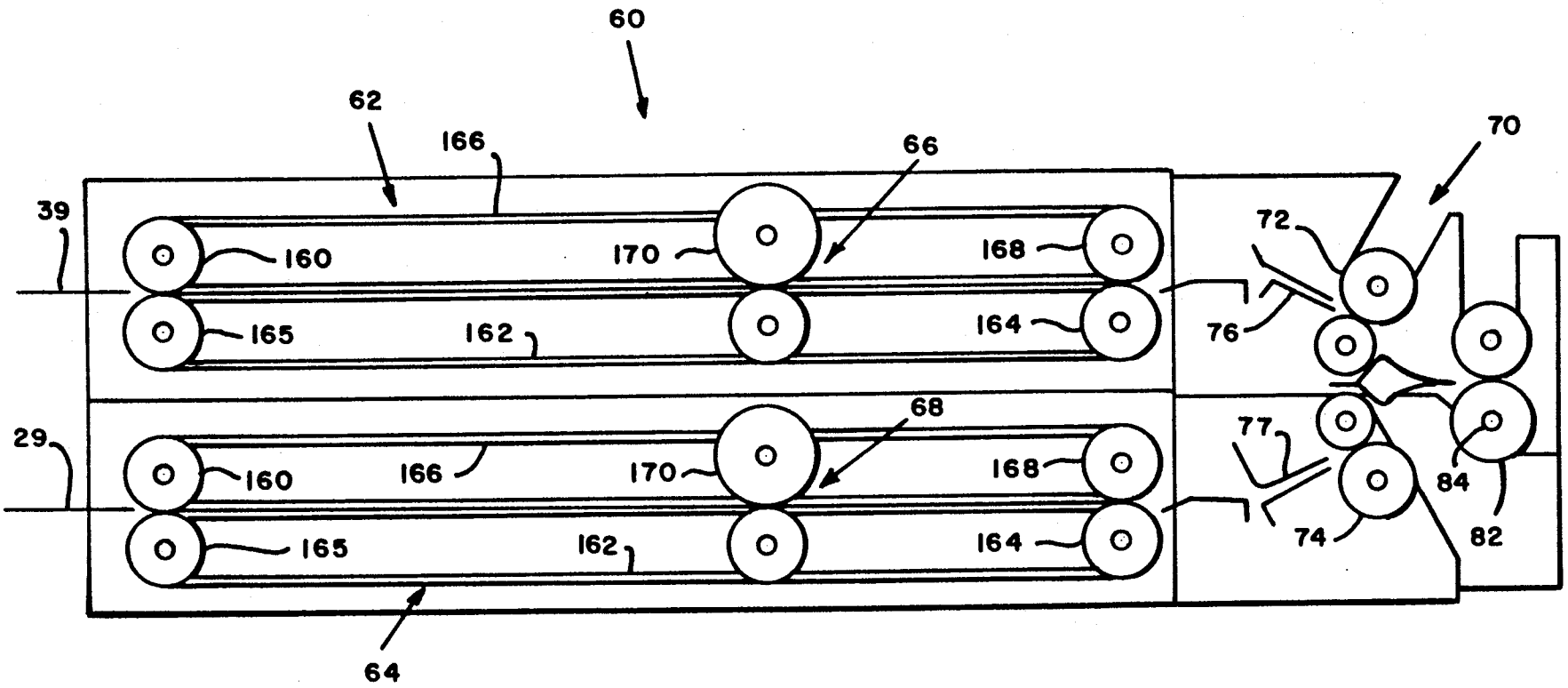
FIG. 7 is a side elevational view of a dual transport unit of the feeder section of FIG. 2.
Figure 8:
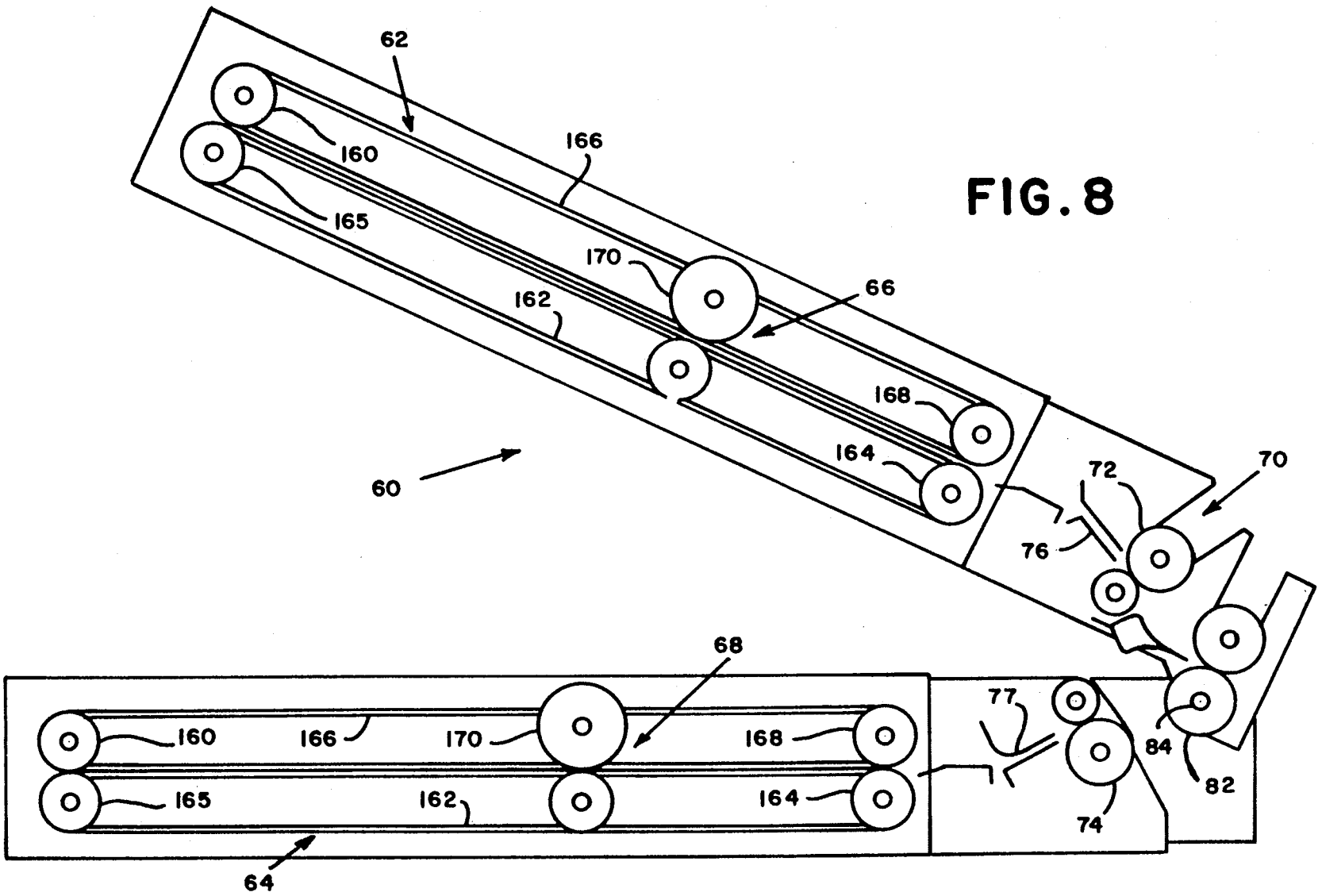
FIG. 8 is a plan view of the dual transport unit of FIG. 7.

Referring now to FIGS. 7 and 8, dual transport and merge unit 60 is shown with transport sections 62 and 64 in normal operating position. Transport sections 62 and 64 each include a plurality of upper belts 166 extended over upper, upstream pulleys 168 and downstream pulleys 160, and a plurality of lower belts 162 extended over lower, upstream pulleys 164 and downstream pulleys 165. The upper reach of lower belts 162 and the lower reach of upper belts 166 operate to convey sheets fed through transport and merge sections 62 and 64 along paper paths 39 and 29 respectively. There are conventional trap assemblies, generally designated 66 and 68, for staging the advancement of sheets in sections 62 and 64 respectively. Trap assemblies 66 and 68 each include a pair of stop roller pairs 170 that are controlled by a conventional clutch and brake arrangement (not shown). Downstream from upper and lower transport sections 62 and 64 are merge roller pairs 72 and 74, respectively, and upper and lower guide plates 76 and 77, respectively, for conveying sheets from upper and lower transport sections 62 and 64 to outlet roller pair 80. It can be seen in FIG. 1 that the two separate paper paths 29 and 39 originating at cut sheet feeders 20 and 30 respectively converge into one paper path 78 at outlet rollers 80.

The lower outlet roller 80 is mounted on a shaft 84 on which are mounted a pair of yokes (not shown) which support the upper, clam-shell housing for transport and merge unit 60. As seen in FIG. 1, the clam-shell housing for transport section 62 supports the upper pair of merge rollers 72 and the upper transport section 62. An open construction of the clam-shell housing provides easy access at all times to sheets in upper transport section 62. It will be understood that a conventional movable cover may be suitably mounted on upper transport section 62 for safety reasons without interfering with accessibility. As shown in FIG. 8, dual transport and merge unit 60 pivots on shaft 84 for easy access to lower transport section 64. A commercially available gas spring (not shown) can be used to maintain the clam-shell housing for transport section 62 in the open position so that jams can be cleared, or other problems involving the lower transport section 64 addressed.

Figure 6:
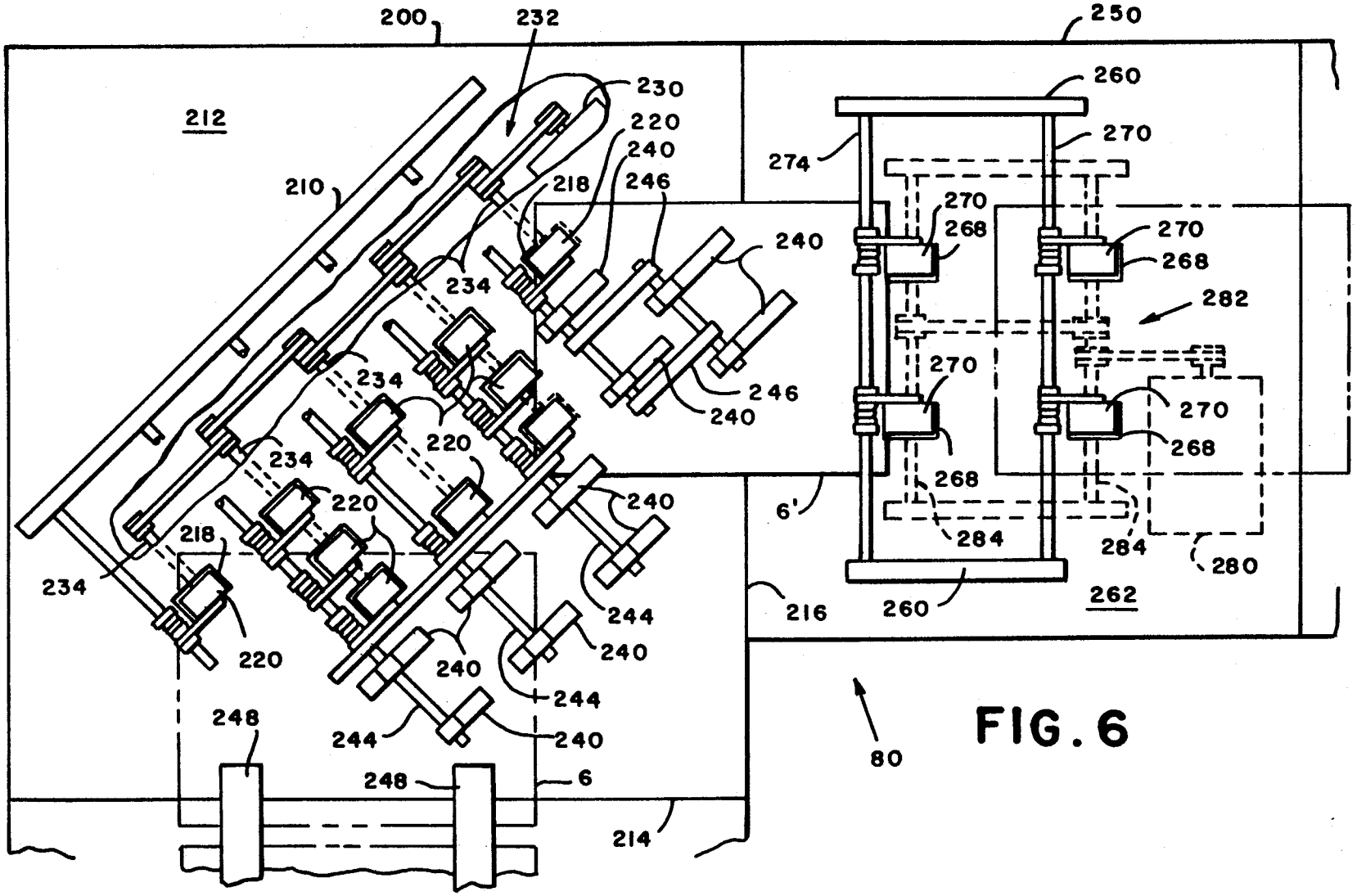
FIG. 6 is a plan view of a right angle transport assembly of the feeder section of FIG. 2.

Referring now to FIGS. 1 and 6, right angle transport assembly 80 includes a 45° transfer unit 200 and an alignment unit 250. Transport assembly 80 is a modified version of the transfer apparatus disclosed in U.S. patent application Ser. No. 608,512, filed on Nov. 2, 1990 and assigned to the assignee of the present invention. The apparatus in application Ser. No. 608,512 includes a transport section comprising a plurality of conveying roller pairs for receiving a flat article, such as a stuffed envelope, being conveyed in a first direction and conveying the flat article in a second direction, which is less than or equal to 45°. There is an alignment section which receives the article from the transport section when the article hits a registration wall extending in a third direction which is orthogonal to the first direction. At that moment, another set of conveying rollers convey the article against the registration wall for further processing. It has been found that the registration wall is suitable for the registration of stuffed envelopes but is not suitable for the registration of single cut sheets. It will be understood that a cut sheet is more susceptible to rumpling as the sheet collides into the registration wall when being conveyed at a high speed.

As seen in FIG. 6, transfer unit 200 includes a plate 210 secured to a deck 212 which is supported by three leg members (not shown). Deck 212 has an input side 214 and an exit side 216. The deck includes a plurality of rectangular slots 218, through which corresponding roller pairs 220 operate to convey sheets 6 in a 45° angle from the direction the sheets are received from dual transport and merge unit 60. Each of slots 218 has protruding in part a continuously driven lower roller of a corresponding roller pair 220 which cooperates with a corresponding biased upper roller to convey sheets 6 across transfer unit 200. The upper rollers of roller pairs 220 are mounted to shafts 244 which are rigidly mounted at one end to plate 210. In the preferred embodiment of the present invention, there are ten roller pairs 220. It will be understood by those skilled in the art that the number and spacing of roller pairs can be changed depending on the particular size sheets being conveyed and the amount of control needed to achieve the right angle change in direction.

Below deck 212 is a variable speed motor 230, connected to a conventional belt and pulley drive system, generally designated 232 for driving shafts 234 on which lower driven rollers of rollers pairs 220 are mounted. It will be understood by those skilled in the art that the orientation of the roller unit 200 is not limited to forty five degrees (45°). Any angle less than forty five degrees (45°) can be used to transport sheets 6 to alignment unit 250. When an alternate angle of deflection is employed, the length of the deck and the number of rollers may increase to complete the right angle change in direction. For a more detailed description of the drive system and roller pair structure reference is made to U.S. patent application Ser. No. 608,512, filed on Nov. 2, 1990 and assigned to the assignee of the present invention, which is incorporated herein by reference.

In operation, the right angle transport assembly 80 takes sheet 6 conveyed from dual transport and merge unit 60 and changes the direction of travel of sheet 6 by ninety degrees (90°) without changing the orientation of the document to a signal point of reference i.e., sheet 6 is not turned when the direction of travel changes.

In the preferred embodiment of the present invention, the speed of the rollers 220 is such that the linear speed of sheet 6 through the transfer unit 200 is slightly faster than the exit speed of sheet 6 from dual transport and merge unit 60. The exit speed of the sheet 6 from dual transport and merge unit 60 may vary from job to job and for different inserting machine. It has been found that using variable speed motor 230, the speed of the rollers 220 on transfer unit 200 can be adjusted accordingly based on any exit speed out of dual transport and merge unit 60.

It has been found that conveying sheet 6 at a high speed, for example, 105 inches per second, through transfer unit 200 causes portions of sheet 6 to lift off of deck 212 unless such sheet portions are restrained. As seen in FIG. 6, a plurality of fingers 240 are mounted to idler roller shafts 244 to restrain sheet 6 from lifting off deck 212 as it is conveyed to transfer unit 200 from dual transport and merge unit 60, and as it is conveyed from transfer unit 200 to alignment unit 250. A rigid link comprising members 246 is used to extend two of fingers 240 beyond the last downstream shaft 244. Finally, there are a pair of fingers 248 mounted at the outlet rollers 80 for urging sheet 6 under fingers 240 to ensure that sheet 6 is engaged by roller pairs 220. Alternate methods for restraining sheet 6 from lifting off deck 212 can be used. For example, a brush that is rigidly mounted above deck 212 can be used to prevent sheet 6 from lifting off deck 212 as sheet 6 is conveyed to alignment unit 250. Another example that can be used in place of fingers 240 is the use of restraining wires positioned at similar locations above deck 212 as fingers 240. An alternate structure to fingers 248 is a rigidly mounted deflecting plate which is mounted at input side 214 of deck 212 to urge sheet 6 towards deck 212.

Alignment unit 250 includes a pair of plates 260 secured to a deck 262. Deck 262 includes a plurality of rectangular slots 268, through which corresponding roller pairs 270 operate to receive sheets 6 from transfer unit 200, maintain suitable alignment and convey sheet 6 downstream for further processing. (For example, as seen in FIG. 1, to accumulator 12 for collecting batches of sheets.) Each of slots 268 has protruding in part a continuously driven lower roller of a corresponding roller pair 270 which cooperates with a corresponding biased upper roller to convey sheets 6 across transfer unit 200. The upper rollers of roller pairs 270 are mounted to shafts 274 which are rigidly mounted to plates 260. In the preferred embodiment of the present invention, there are four roller pairs 270. It will be understood by those skilled in the art that the number and spacing of roller pairs can be changed depending on the particular size sheets being conveyed and the amount of control needed to complete the right angle change in direction. Below deck 262 is a variable speed motor 280, connected to a conventional belt and pulley drive system, generally designated 282 for driving shafts 284 on which lower driven rollers of rollers pairs 270 are mounted.

The upstream roller pairs 270 are positioned so that sheet 6' just enters the nips of the upstream roller pairs at the instant sheet 6' is about to leave the control of the most downstream roller pairs 220 of transfer unit 200. Once sheet 6' is engaged by the upstream roller pairs 270, sheet 6' makes a second forty-five degree (45°) change in the direction of travel. As seen in FIG. 6, the orientation of sheet 6' from a single point of reference is maintained as the document travels across right angle transport 80. The speed of roller pairs 270 is slightly faster than the speed of roller pairs 220 so that there is a smooth transition as sheet 6' leaves the control of transfer unit 200 and enters the control of alignment unit 250.

It will be appreciated by those skilled in the art that right angle transfer assembly 80 provides a constant positive drive of sheets 6, and eliminate the abrupt mechanical delay or stop previously associated with conveying landscape to portrait or portrait to landscape. It has been found that engaging sheets 6 at all times by two or more rollers provides a steady positive drive through right angle transport assembly 80 which results in better control of sheets 6 travelling at such high speeds.

It has also been found that engaging sheets 6 by only one directional drive at a time further provides better control at higher speeds. In the preferred embodiment of the present invention, sheet 6' is engaged by the rollers 270 in alignment unit 250 as sheet 6' is released by rollers 220 in transfer unit 200. It has been found that in conveying sheets in this manner it is necessary that roller pairs 270 seize control of sheet 6' at the instant sheet 6' is released by roller pairs 220.

Transfer unit 200 shown in FIG. 6 performs a change in direction to the right. It will be appreciated by those skilled in the art that a transfer unit configured in the mirror image of unit 200 will perform a change in direction to the left.

In the preferred embodiment of the present invention, feeders 20 and 30, transport 40, dual transport and merge 60, transfer unit 200 and alignment unit 250 are each independently driven and controlled and are not an integral part of the basic inserting machine drive system.

In operation, feeders 20 and 30 each feed sheets 6 seriatim along respective paper paths 29 and 39. As scanners 28 and 38 read control information printed on the sheets being fed, the control information is sent to the control system (not shown) of the inserting machine which controls the feeding operation of feeders 20 and 30 as well as the staging areas of two stage transport 40 and dual transport and merge unit 60. In accordance the present invention, both feeders 20 and 30 read control information on sheets 6. Such an arrangement is desirable when in addition to the typical control document, other documents containing further control information, such as checks, which are to be collected with the control document to form a collation, can be fed from a second feeder. Whenever one of the feeders is placed in a momentary stop mode because the other feeder is feeding sheets, the feeder being stopped does not stop feeding until a sheet is present in each of the corresponding staging areas. For example, when feeder 20 is stopped, feeder 20 stops feeding after a sheet is staged at the two staging areas 46 in dual stage transport 40 and at the staging area 68 in lower transport section 64 of dual transport and merge unit 60. This arrangement maximizes the throughput of the cut sheet feeder section 10 because the sheets are present at selected intervals along paper paths 29 and 39 thus eliminating the time it takes for a sheet to be fed from the respective feeder to the merge section 70 of dual transport and merge unit 80.

As one of feeders 20 and 30 continues feeding, the brake releases and the clutch engages to drive stop roller pairs 170 at the respective staging areas 68 and 66 in dual transport and merge unit 80, wherein the sheet staged is conveyed through merge rollers 70. If feeder 20 is the feeder that continues feeding, the identical release of stop roller pairs 48 occurs simultaneously at staging areas 46 in dual stage transport 40.

As sheet 6 is conveyed from outlet rollers 80 in dual transport and merge unit 80, it is engaged by roller pairs 220 in transfer unit 200 which convey sheet 6 at a 45° angle while maintaining the orientation of sheet 6 as seen in FIG. 6. As sheet 6 is leaving the control of transfer unit 200, it is engaged by roller pairs 270 in alignment unit 250. Once sheet 6 is in the control of alignment unit 250, sheet 6 has been successfully conveyed from landscape to portrait for further processing in the inserting machine.

The preferred embodiment of the present invention is shown and described for conveying sheets 6 along paper paths 29 and 39 with the short edge of the sheet parallel to the direction of travel, commonly referred to as landscape. After the direction of conveyance is changed by right angle transport assembly 80 without turning sheet 6, the long edge of the sheet is parallel to the direction of travel as sheets 6 are conveyed along paper path 78, commonly referred to as portrait. It will be understood by those skilled in the art that the present invention is also suitable for conveying portrait to landscape, although some adjustments may be necessary to the positioning of the rollers and guides in the right angle transport assembly.

It will be understood that the present invention can be used with alternate conveying means, such as a one or no stage transport or a roller and deck conveying means.

While the present invention has been disclosed and described with reference to a single embodiment thereof, it will be apparent, as noted above that variations and modifications may be made therein. It is, thus, intended in the following claims to cover each variation and modification that falls within the true spirit and scope of the present invention.

What is claimed is:

1. An apparatus for conveying sheets of paper along a paper path from an upstream conveying device to a downstream conveying device, comprising:

an outer frame having an inlet end for connection to an upstream conveying device and an outlet end for connection to a downstream conveying device, the outer frame having a hollow interior and an opening in each of said inlet and outlet ends for conveying sheets there through;

a drawer frame slidably mounted to said outer frame, said drawer frame being slidable through an open side of said outer frame between a closed position within said outer frame to an open position outside said outer frame;

means mounted in said drawer frame for conveying along a paper path sheets of paper received from the upstream conveying device to the downstream conveying device, said conveying means including drive means for driving said conveying means, said drawer frame having an opening at each end for conveying sheets there through;

wherein said conveying means is operational when said drawer frame is in said closed position and said paper path within said drawer frame is accessible when said drawer frame is in said open position.

2. The apparatus according to claim 1 wherein said conveying means includes a belt and pulley transport assembly suitably mounted to said drawer frame, and said drive means includes a motor mounted to said drawer frame and operatively coupled to said belt and pulley assembly.

3. The apparatus according to claim 1 wherein said outer frame includes a bottom plate, said drawer frame being slidably mounted to said bottom plate.

4. The apparatus according to claim 1 further comprising locking means for locking said drawer frame in said closed position.

5. The apparatus according to claim 1 wherein said conveying means includes at least one staging area for stopping the advancement of sheets being conveyed along said paper path.

6. The apparatus according to claim 2 wherein said conveying means includes at least one set of stop roller pairs stopping the advancement of sheets being conveyed along said paper path.

* * * * *